US009414731B2

(12) United States Patent
Soejima

(10) Patent No.: US 9,414,731 B2
(45) Date of Patent: Aug. 16, 2016

(54) SELF-PROPELLED CLEANER

(71) Applicant: Sharp Kabushiki Kaisha, Osaka-shi, Osaka (JP)

(72) Inventor: Ryohichi Soejima, Osaka (JP)

(73) Assignee: Sharp Kabushiki Kabushiki, Osaka (JP)

( * ) Notice: Subject to any disclaimer, the term of this patent is extended or adjusted under 35 U.S.C. 154(b) by 0 days.

(21) Appl. No.: 14/767,081

(22) PCT Filed: Feb. 21, 2014

(86) PCT No.: PCT/JP2014/054179

§ 371 (c)(1),
(2) Date: Aug. 11, 2015

(87) PCT Pub. No.: WO2014/196227

PCT Pub. Date: Dec. 11, 2014

(65) Prior Publication Data

US 2016/0000288 A1 Jan. 7, 2016

(30) Foreign Application Priority Data

Jun. 7, 2013 (JP) ..... 2013-120632

(51) Int. Cl.
*A47L 9/28* (2006.01)
*A47L 9/04* (2006.01)

(52) U.S. Cl.
CPC ..... *A47L 9/2826* (2013.01); *A47L 9/0411* (2013.01); *A47L 9/2815* (2013.01); *A47L 9/2831* (2013.01); *A47L 9/2842* (2013.01); *A47L 9/2847* (2013.01); *A47L 9/2852* (2013.01); *A47L 2201/06* (2013.01)

(58) Field of Classification Search
CPC ... A47L 9/2826; A47L 9/2842; A47L 9/2847; A47L 9/2831; A47L 9/0411; A47L 9/2815; A47L 9/2852; A47L 2201/06
See application file for complete search history.

(56) References Cited

U.S. PATENT DOCUMENTS 6,076,227 A * 6/2000 Schallig ..... A47L 9/04 15/319
8,742,926 B2 * 6/2014 Schnittman ..... A47L 9/106 15/319
2005/0166355 A1 * 8/2005 Tani ..... A47L 9/2805 15/319
2012/0125363 A1 * 5/2012 Kim ..... A47L 9/28 134/6

(Continued)

FOREIGN PATENT DOCUMENTS

JP 7-124091 A 5/1995
JP 2002-355204 A 12/2002

(Continued)

OTHER PUBLICATIONS

Official Communication issued in International Patent Application No. PCT/JP2014/054179, mailed on May 27, 2014.

*Primary Examiner* — Dung Van Nguyen
(74) *Attorney, Agent, or Firm* — Keating & Bennett, LLP

(57) ABSTRACT

A self-propelled cleaner including: a movement unit configured to move a housing; a blower unit configured to generate an air current for sucking dust on a floor surface into the housing; a dust detection unit configured to detect dust contained in the air current; and a control unit configured to control the movement unit and/or the blower unit to select a cleaning mode according to a detection result of the dust detection unit, wherein the control unit is capable of changing a threshold value for selecting the cleaning mode.

5 Claims, 19 Drawing Sheets

(56) References Cited

U.S. PATENT DOCUMENTS

| | | | | |
|---|---|---|---|---|
| 2012/0222224 | A1* | 9/2012 | Yoon | A47L 11/33 15/52.1 |
| 2013/0000675 | A1* | 1/2013 | Hong | A47L 9/009 134/18 |

FOREIGN PATENT DOCUMENTS

| | | | |
|---|---|---|---|
| JP | 2004-243202 | A | 9/2004 |
| JP | 2007-195789 | A | 8/2007 |
| JP | 2012-152303 | A | 8/2012 |

* cited by examiner

Fig.7

S

| TYPE OF FLOOR | WOODEN | TATAMI | CARPET |
|---|---|---|---|
| MOTOR CURRENT | Less than a1 | Not less than a1 and less than a2 | Not less than a2 |

A

Fig.10

S

| TYPE OF FLOOR | WOODEN | TATAMI | CARPET |
|---|---|---|---|
| THRESHOLD VALUE OF NUMBER OF | n1 | n2 | n3 |

N

Fig.18

S

| TYPE OF FLOOR SURFACE | WOODEN | TATAMI | CARPET |
| --- | --- | --- | --- |
| SECOND CLEANING MODE | Electric blower: high-power<br>Main brush: low-power<br>Repeated cleaning: ON | Electric blower: high-power<br>Main brush: low-power<br>Repeated cleaning: OFF | Electric blower: high-power<br>Main brush: high-power<br>Repeated cleaning: ON |

M

SELF-PROPELLED CLEANER

TECHNICAL FIELD

The present invention relates to a self-propelled cleaner provided with a movement unit.

BACKGROUND ART

Recently, there has been known a self-propelled cleaner provided with a movement unit for autonomously cleaning a floor surface while autonomously moving with a predetermined movement pattern. There has also been developed a type of the self-propelled cleaner capable of reducing remaining dust which is left without being removed from the floor surface, even if dust is concentrated on a specific place in a room (for example, Patent Document 1).

FIG. 19 is a block diagram illustrating a self-propelled device 201 described in Patent Document 1. The self-propelled device 201 includes a dust detection unit 202 detecting dust on a floor surface, a movement unit 204, a mode control unit 206 instructing a predetermined movement pattern, a movement control unit 205 controlling the direction of the movement of the movement unit 204, and a measuring unit 203 measuring a distance to an obstacle. When the dust detection unit 202 detects dust on a surface to be cleaned, the self-propelled device 201 changes the movement pattern of the mode control unit 206 such that the self-propelled device 201 carefully moves around the part where dust is detected, and then, returns to a normal operation. Patent Document 1 describes a unit, as the dust detection unit 202, in which a light-emitting unit and a light-receiving unit are mounted on a suction unit 208 which sucks dust on the surface to be cleaned. This unit detects a dust amount by detecting that light emitted from the light-emitting unit is intercepted when dust passes between the light-emitting unit and the light-receiving unit.

CITATION LIST

Patent Document

Patent Document 1: Japanese Unexamined Patent Publication No. 2004-243202 (published on Sep. 2, 2004)

DISCLOSURE OF THE INVENTION

Problem to be Solved by the Invention

However, the self-propelled device 201 described in Patent Document 1 detects dust on a floor surface, regardless of an aspect of the floor surface, e.g., a type of the floor surface, in the same way by the dust detection unit 202. Movement of dust to be sucked actually varies depending on the state of the floor surface, so that the result of the detection by the dust detection unit 202 is considered to also vary with the variation in the movement. Specifically, a conventional self-propelled cleaner dose not perform a detection of dust according to an aspect of a floor surface, resulting in that a region where dust is left without being sucked or a region that is cleaned excessively carefully is generated depending on an aspect of a floor surface.

The present invention is accomplished in view of the above circumstance, and aims to provide a self-propelled cleaner that reduces remaining dust which is left without being removed from the floor surface, and has enhanced cleaning efficiency, according to conditions of a floor surface.

Means for Solving the Problems

A self-propelled cleaner according to the present invention includes: a movement unit configured to move a housing; a blower unit configured to generate an air current for sucking dust on a floor surface into the housing; a dust detection unit configured to detect dust contained in the air current; and a control unit configured to control the movement unit and/or the blower unit to select a cleaning mode according to a detection result of the dust detection unit, wherein the control unit is capable of changing a threshold value for selecting the cleaning mode.

Effect of the Invention

The present invention can provide a self-propelled cleaner that reduces remaining dust which is left without being removed from the floor surface, and has enhanced cleaning efficiency, according to an aspect of a floor surface.

BRIEF DESCRIPTION OF THE DRAWINGS

FIG. 7 is a table illustrating a relationship between a type of a floor surface and a motor current value stored in a storage section 101 according to the first embodiment of the present invention.

FIG. 10 is a table illustrating a relationship between a type of a floor surface and a threshold value of a number of pulses stored in the storage section 101 according to the first embodiment of the present invention.

FIG. 18 is a table illustrating one example of a type of a second cleaning mode executed by a self-propelled cleaner 1 according to a fifth embodiment of the present invention.

MODE FOR CARRYING OUT THE INVENTION

First Embodiment

A self-propelled cleaner 1 according to the first embodiment of the present invention will be described. The self-propelled cleaner 1 includes a dust detection unit for detecting dust contained in a sucked air current, and performs cleaning by selecting a cleaning mode according to the detection result of the dust detection unit. The self-propelled cleaner 1 also includes a floor surface detection unit for detecting an aspect of a floor surface, such as a type of a floor surface, and changes a threshold value used for selecting the cleaning mode according to the detection result of the floor surface detection unit.

The specific structure of the self-propelled cleaner 1 will be described with reference to the drawings.

(Structure of Self-Propelled Cleaner 1)

Figure 1:
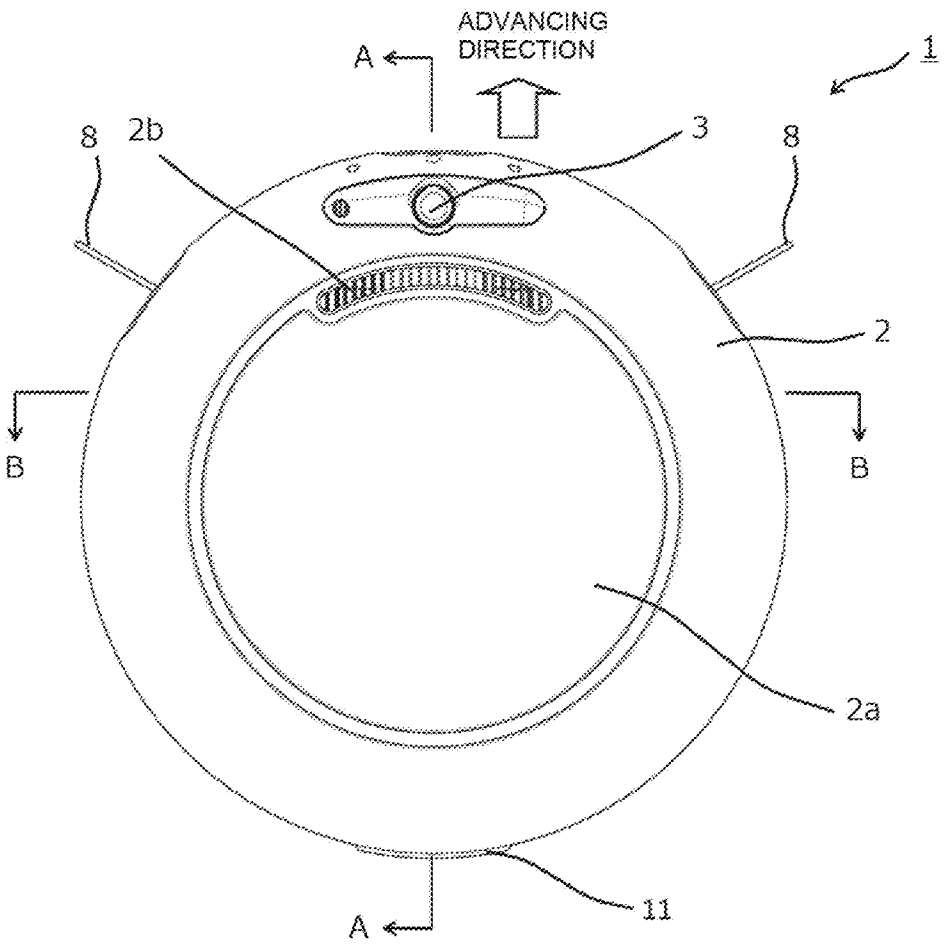
FIG. 1 is a plan view illustrating a self-propelled cleaner 1 according to a first embodiment of the present invention.

FIG. 1 is a plan view illustrating the self-propelled cleaner 1. The advancing direction when the self-propelled cleaner 1 autonomously moves to perform cleaning is defined as a front, and this direction is indicated by an arrow in FIG. 1. The direction opposite to the advancing direction is defined as a back.

The self-propelled cleaner 1 has a circular housing 2 viewed from top. The housing 2 is provided with, on its top surface, a lid 2*a* that opens and closes relative to the housing 2 for attaching and detaching a later-described dust collection section 6, and an exhaust port 2*b* for exhausting air from which dust is removed by the dust collection section 6.

The housing 2 also includes, at a front part on the top surface, a signal receiving section 3 for receiving a return signal from a battery charger (not illustrated) of the self-propelled cleaner 1 and a remote control signal from a remote controller (not illustrated). When finishing cleaning, for example, the self-propelled cleaner 1 can autonomously return to the battery charger on receipt of the return signal. The self-propelled cleaner 1 can also accept various instructions and settings from a user on receipt of the remote control signal. A transmission medium of signals is not particularly limited. As for the transmission medium of the return signal, an infrared ray such as an IrDA or a remote controller, or radio waves such as Bluetooth (registered trademark), WiFi (registered trademark), or IEEE 802.11 can be used.

A charging terminal 11 is mounted to the back side face of the housing 2. The charging terminal 11 is electrically connected to a power supply terminal mounted to the battery charger, when the self-propelled cleaner 1 returns to the battery charger. A later-described side brush 8 is mounted on the bottom surface of the housing 2. As illustrated, the side brush 8 is mounted such that a part thereof projects from the housing in a plan view.

Figure 2:
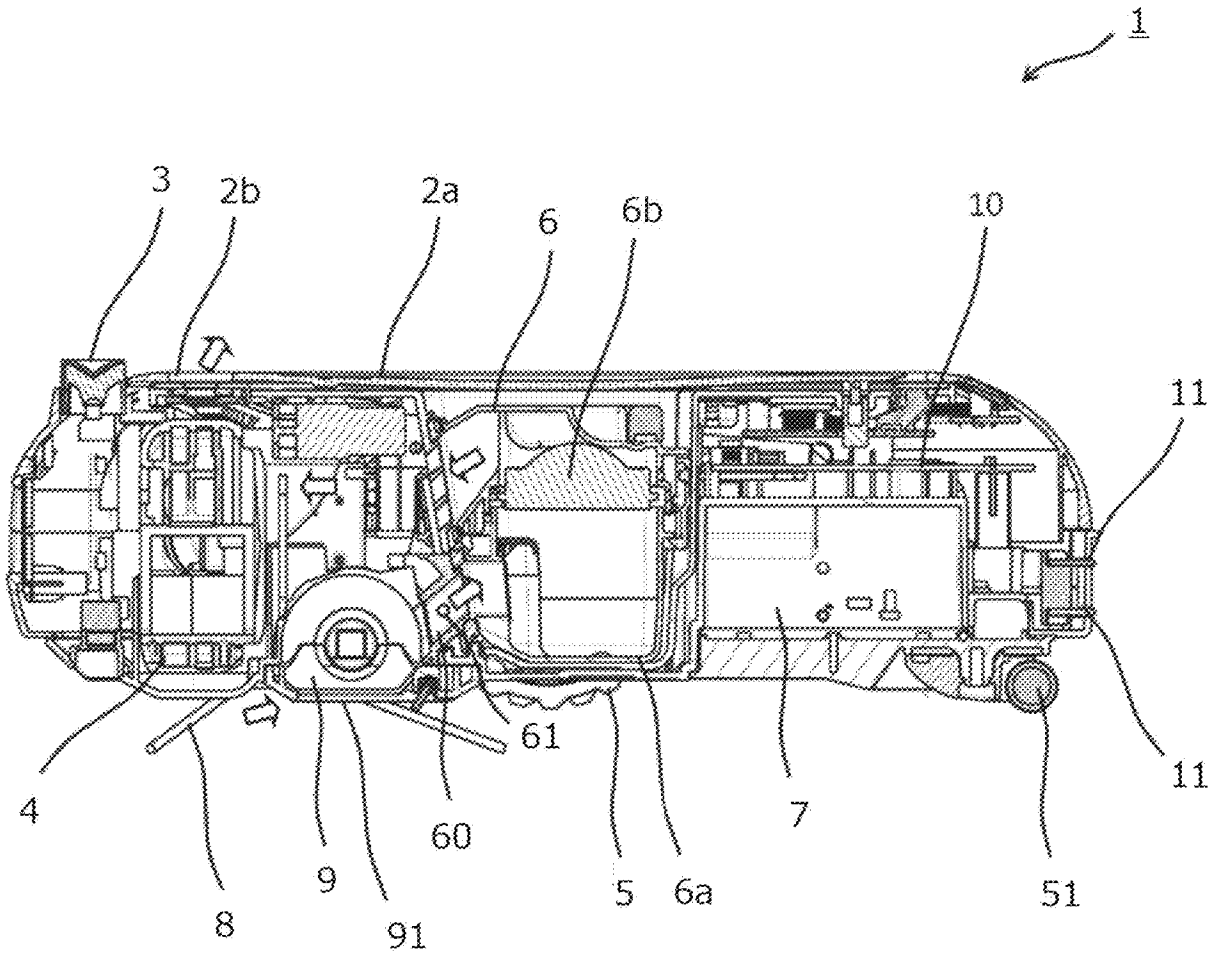
FIG. 2 is a schematic view illustrating a cross-section of the self-propelled cleaner 1 in FIG. 1 viewed in a direction of an arrow AA.

FIG. 2 is a schematic view illustrating a cross-section of the self-propelled cleaner 1 in FIG. 1 viewed in a direction of an arrow AA. The housing 2 includes inside an electric blower 4 which generates an air current for sucking dust on a floor surface, the dust collection section 6 which separates dust from the sucked air and temporarily stores this dust, and a suction passage 60 which guides the sucked air to the dust collection section 6. The electric blower 4 is one example of a blowing unit according to the present invention.

The dust collection section 6 includes a bottomed dust collection container 6*a* and a filter 6*b* mounted at an upper part of the dust collection container 6*a*. To discard dust in the dust collection container 6*a*, a user opens the lid 2*a* of the housing 2 upward as viewed in a sheet surface. With this, the user can remove the dust collection section 6 from the housing 2.

With the arrangement of the electric blower 4, the dust collection section 6, and the suction passage 60 as described above, an air current flowing from a suction opening flows into the dust collection section 6 through the suction passage 60, and after dust contained in the air current is separated by the filter 6*b* of the dust collection section 6, the air current flows out of the dust collection section 6, and reaches the electric blower 4. The air current exhausted from the electric blower 4 is exhausted obliquely backward from the exhaust port 2*b*. The flow of the air current is indicated by arrows in FIG. 2. The suction passage 60 is provided with a dust detection section 61 for detecting dust sucked by the electric blower 4. The dust detection section 61 will be described later.

A pair of left and right drive wheels 5, viewed in the advancing direction, is provided at the center of the bottom surface of the housing 2 so as to project from the bottom surface. Each of the left and right drive wheels 5 is independently driven by a later-described wheel drive section 50. The self-propelled cleaner 1 moves forward or backward by the rotation of both drive wheels 5 in the same direction, while changes its moving direction when each of both drive wheels 5 rotates in the opposite direction. The drive wheels 5 and the wheel drive section 50 are one example of a moving unit according to the present invention. A rear wheel 51 is mounted on the bottom surface of the housing 2 at the back side. The rear wheel 51 is not driven, but follows the forward and backward motion and the turning motion of the self-propelled cleaner 1.

A rectangular suction opening (not illustrated) for sucking dust on a floor surface is recessed at the center of the bottom surface of the housing 2. A main brush 9 rotating about a rotation shaft supported parallel to the bottom surface is disposed in the suction opening. The main brush 9 is driven by a later-described brush drive section 90 to scrape out dust on a floor surface and guide the scraped dust to the suction passage 60. A suction opening cover 91 that covers a part of the suction opening for preventing the main brush 9 from falling during the cleaning operation is detachably provided to the suction opening. The main brush 9 is provided such that a part thereof projects from the suction opening cover 91 to sweep a floor surface.

A pair of left and right side brushes 8 rotating with a rotation shaft supported perpendicular to the bottom surface is provided at the outside of the suction opening. The side brushes 8 are driven by the brush drive section 90 to sweep and guide dust at the outside of the suction opening toward the suction opening. The main brush 9 and the side brushes 8 are one example of a brush unit according to the present invention.

A battery 7 and a control board 10 are provided at the back side in the housing 2. The control board 10 is provided with a control section 100 and a storage section 101 which are described later.

The battery 7 is a power supply source of the self-propelled cleaner 1. When receiving an instruction of a cleaning operation, power is supplied from the battery 7, whereby the electric blower 4, the drive wheels 5, the side brushes 8, and the main brush 9 are driven. A large-capacity rechargeable battery which is repeatedly rechargeable is desirably used for the battery 7. A lead battery, a nickel hydride battery, or a lithium ion battery is used for the battery 7, for example.

Figure 3:
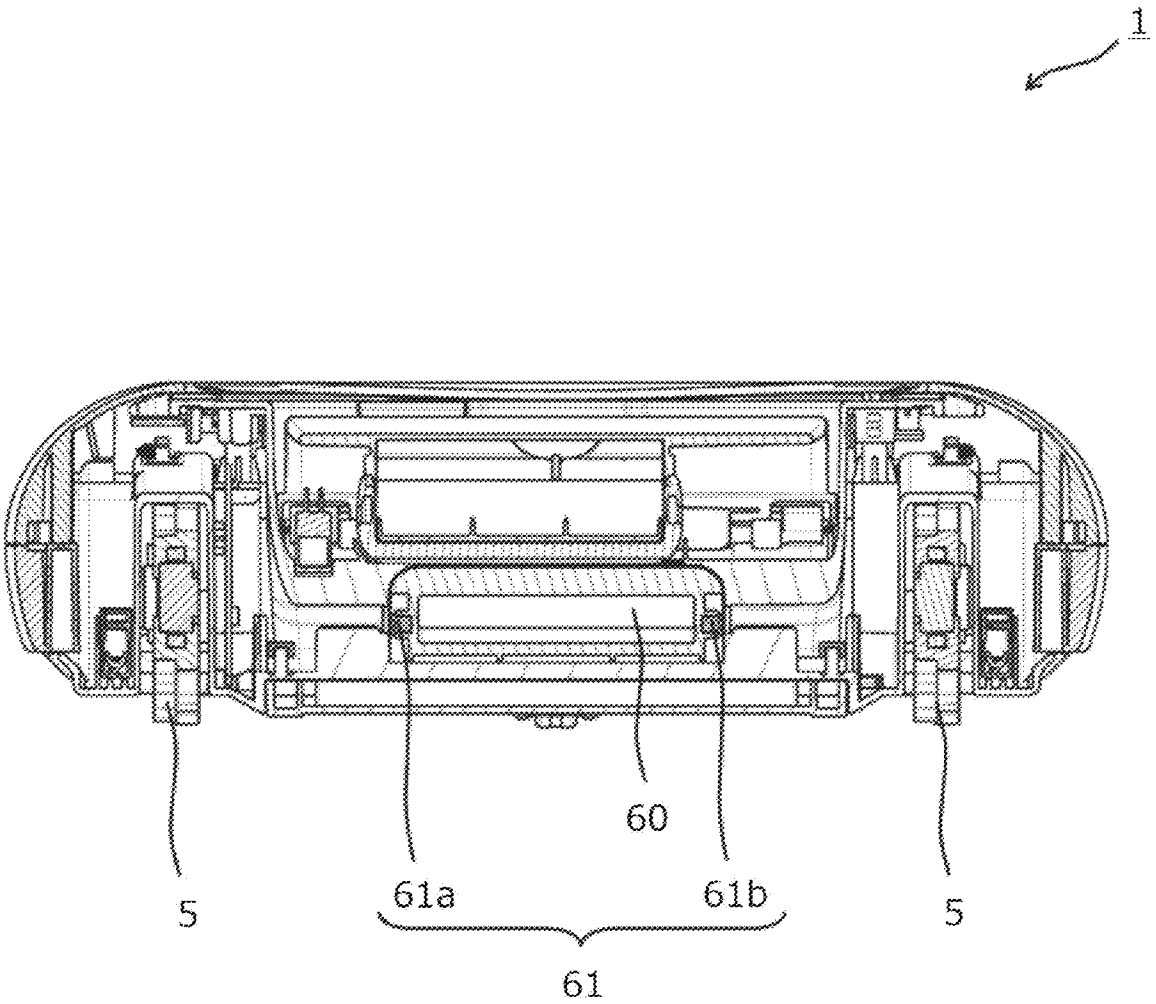
FIG. 3 is a schematic view illustrating a cross-section of the self-propelled cleaner 1 in FIG. 1 viewed in a direction of an arrow BB.

FIG. 3 is a schematic view illustrating a cross-section of the self-propelled cleaner 1 in FIG. 1 viewed in a direction of an arrow BB. The dust detection section 61 includes a light-emitting unit 61*a* and a light-receiving unit 61*b*, which are mounted to be opposite to each other on the suction passage 60. The dust detection section 61 is one example of a dust detection unit according to the present invention.

Figure 4:
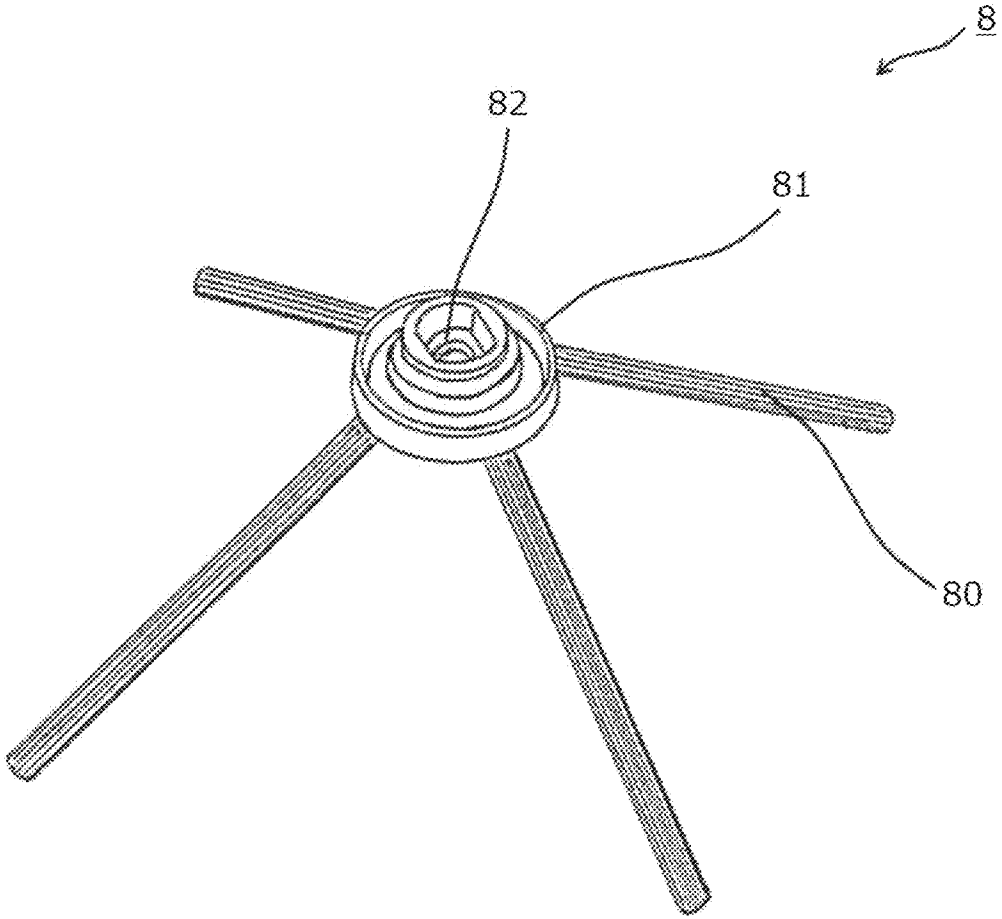
FIG. 4 is a perspective view illustrating a side brush 8 according to the first embodiment of the present invention.

FIG. 4 is a perspective view illustrating the side brush 8. The side brush 8 includes a brush bundle 80 and a brush base 81 to which a plurality of brush bundles 80 is radially implanted.

The brush bundle 80 is formed by bundling flexible brush bristles. A material of the brush bristle can appropriately be selected according to a floor surface. For example, a chemical fiber such as nylon or polypropylene, an animal fiber, or a plant fiber, or a mixture thereof can be used for the brush bristle.

The brush bundle 80 is implanted downward to the brush base 81 with a predetermined angle. The brush bundle 80 is formed to be in contact with a floor surface when being mounted to the self-propelled cleaner 1. A tip end of the brush bundle 80 is deformed along the floor surface.

A through-hole 82 into which a rotation shaft (not illustrated) projecting from the bottom surface of the housing 2 is inserted is formed at the center of the brush base 81. The side brush 8 is attached to the housing 2 by use of a screw or a washer with the rotation shaft being inserted into the through-hole 82.

Figure 5:
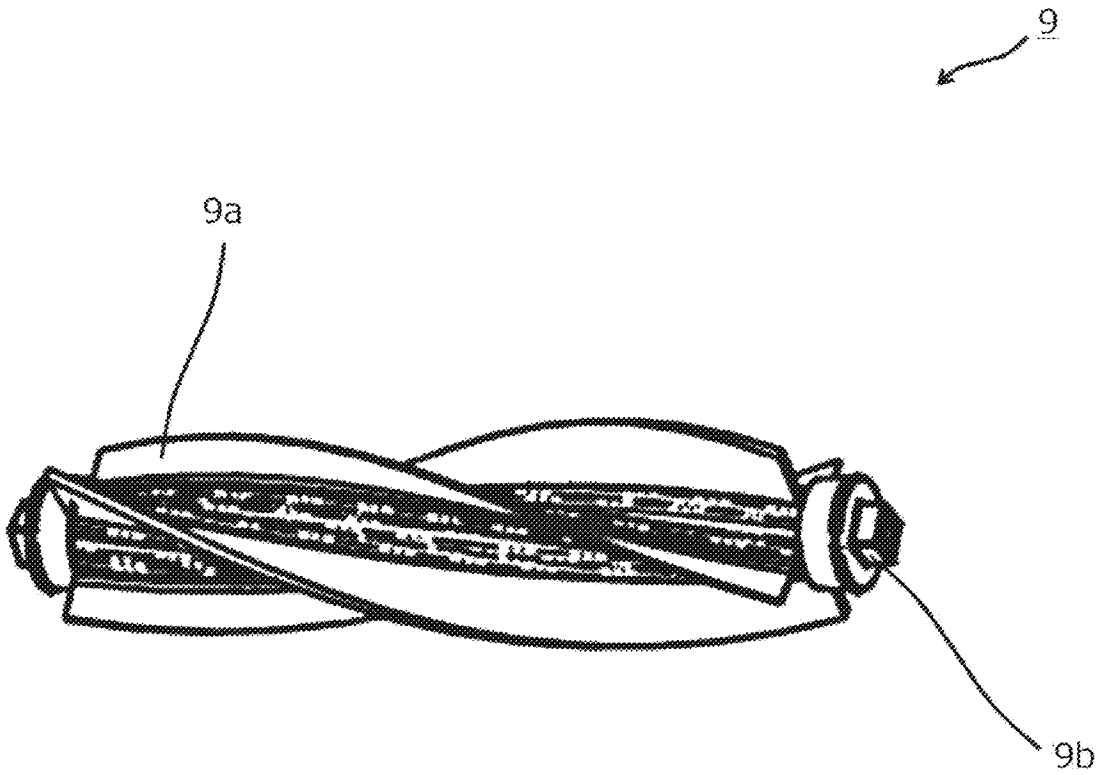
FIG. 5 is a perspective view illustrating a main brush 9 according to the first embodiment of the present invention.

FIG. 5 is a perspective view of the main brush 9. The main brush 9 includes a brush bundle 9*a* and a shaft 9*b* to which the brush bundle 9*a* is implanted.

Similar to the brush bundle 80, the brush bundle 9*a* is formed by bundling flexible brush bristles. The brush bundle 9*a* is helically implanted on the outer peripheral surface of the shaft 9*b*. A flexible blade may be mounted to the shaft 9*b* in addition to or in place of the brush bundle 9*a*.

The shaft 9*b* is a rotation shaft of the main brush 9. Each of both ends of the shaft 9*b* is fitted to each of a pair of shaft support portions which are formed at the suction opening of the housing 2 for rotatably supporting the main brush 9.

Next, the configuration of the self-propelled cleaner 1 will be described.

(Configuration of Self-Propelled Cleaner 1)

Figure 6:
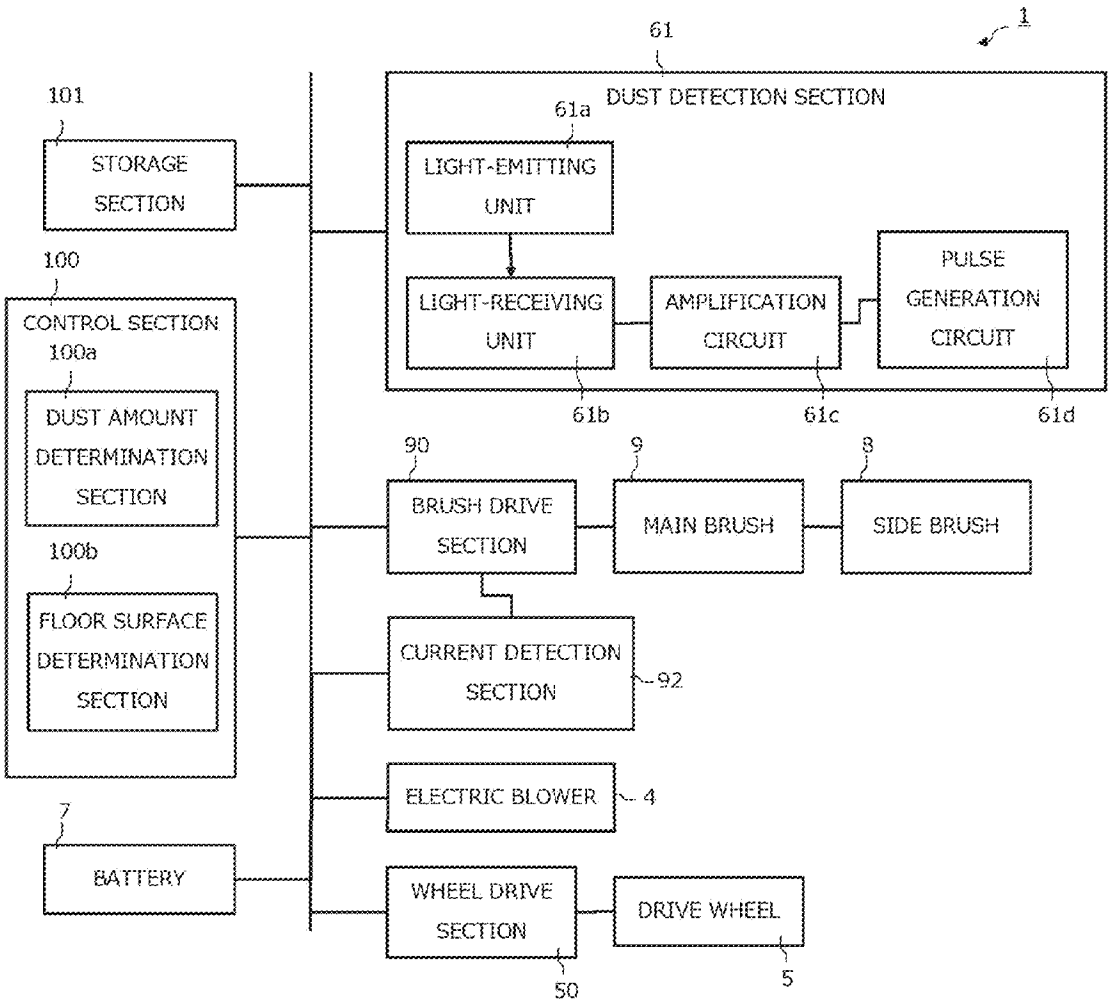
FIG. 6 is a block diagram illustrating a main configuration of the self-propelled cleaner 1 according to the first embodiment of the present invention.

FIG. 6 is a block diagram illustrating a main configuration of the self-propelled cleaner 1. The self-propelled cleaner 1 includes the storage section 101, the control section 100, the wheel drive section 50, the brush drive section 90, a current detection section 92, and the dust detection section 61.

The storage section 101 stores various programs executed by the later-described control section 100, and various data pieces used and generated upon the execution of various programs. The storage section 101 comprises, for example, a non-volatile storage device such as a ROM (Read Only Memory), a flash memory, or an HDD (Hard Disk Drive), and a volatile storage device forming an operating region, such as a RAM (Random Access Memory).

The control section 100 generally controls each section of the self-propelled cleaner 1 based on the programs or data stored in the storage section 101. With the execution of the programs, a later-described dust amount determination section 100*a* and a floor surface determination section 100*b* are constructed in the control section 100. The control section 100 is one example of a control unit according to the present invention.

The wheel drive section 50 rotates the drive wheels 5. The wheel drive section 50 includes a motor and a power transmission mechanism that transmits the rotation of the motor to the drive wheels 5, for example.

The brush drive section 90 rotates the side brushes 8 and the main brush 9. The drive section 90 includes a motor and a power transmission mechanism that transmits the rotation of the motor, such as a belt and a pulley, to the side brushes 8 and the main brush 9. In the self-propelled cleaner 1 according to the present embodiment, the rotation of the motor is transmitted to the main brush 9 to rotate the main brush 9, and the rotation of the main brush 9 is also transmitted to the side brushes 8 to rotate the side brushes 8.

The current detection section 92 detects a motor current of the brush drive section 90, and outputs the detected motor current value to the floor surface determination section 100*b* of the control section 100. The current detection is performed with the motor being rotated with a predetermined rotation speed. The current detection section 92 is one example of a floor surface detection unit according to the present invention.

The relationship between a type of a floor surface and a motor current value is stored beforehand in the storage section 101. The floor surface detection section 100*b* determines a type of a floor surface based on the detected motor current value and the relationship between a type of a floor surface and a motor current value stored beforehand in the storage section 101.

FIG. 7 is one example of a table illustrating a relationship between a type of a floor surface and a motor current value stored in the storage section 101. In FIG. 7, S indicates a type of a floor surface, and A indicates a motor current value corresponding to each floor surface.

In the present embodiment, when the detected motor current value is less than a1, the floor surface determination section 100*b* determines that the floor surface is a wooden floor surface. When the detected motor current value is not less than a1 and less than a2, the floor surface determination section 100*b* determines that the floor surface is a tatami mat, a straw mat. When the detected motor current value is not less than a2, the floor surface determination section 100*b* determines that the floor surface is a carpet. The information relating to the determined floor surface is stored in the storage section 101.

The dust detection section 61 detects dust contained in the air current sucked by the self-propelled cleaner 1. The dust detection section 61 is one example of a dust detection unit according to the present invention. In the present embodiment, the dust detection section 61 is an optical sensor including the light-emitting unit 61*a* and the light-receiving unit 61*b*, which are provided to be opposite to each other, for detecting dust from a change in an output from the light-receiving unit 61*b*. An infrared light-emitting diode can be used as the light-emitting unit 61*a*, for example. A phototransistor can be used as the light-receiving unit 61*b*, for example.

The dust detection section 61 also includes an amplification circuit 61*c* and a pulse generation circuit 61*d*. The amplification circuit 61*c* is a circuit that amplifies an output from the light-receiving unit 61*b*. A current-voltage conversion circuit can be used for the amplification circuit 61*c*, for example. The pulse generation circuit 61*d* outputs a pulse according to an output from the amplification circuit 61*c*.

The dust amount determination section 100*a* determines an amount of dust based on a number of pulses outputted from the pulse generation circuit 61*d*. A specific example of determining an amount of dust will be described with reference also to FIGS. 8 and 9.

Figure 8:
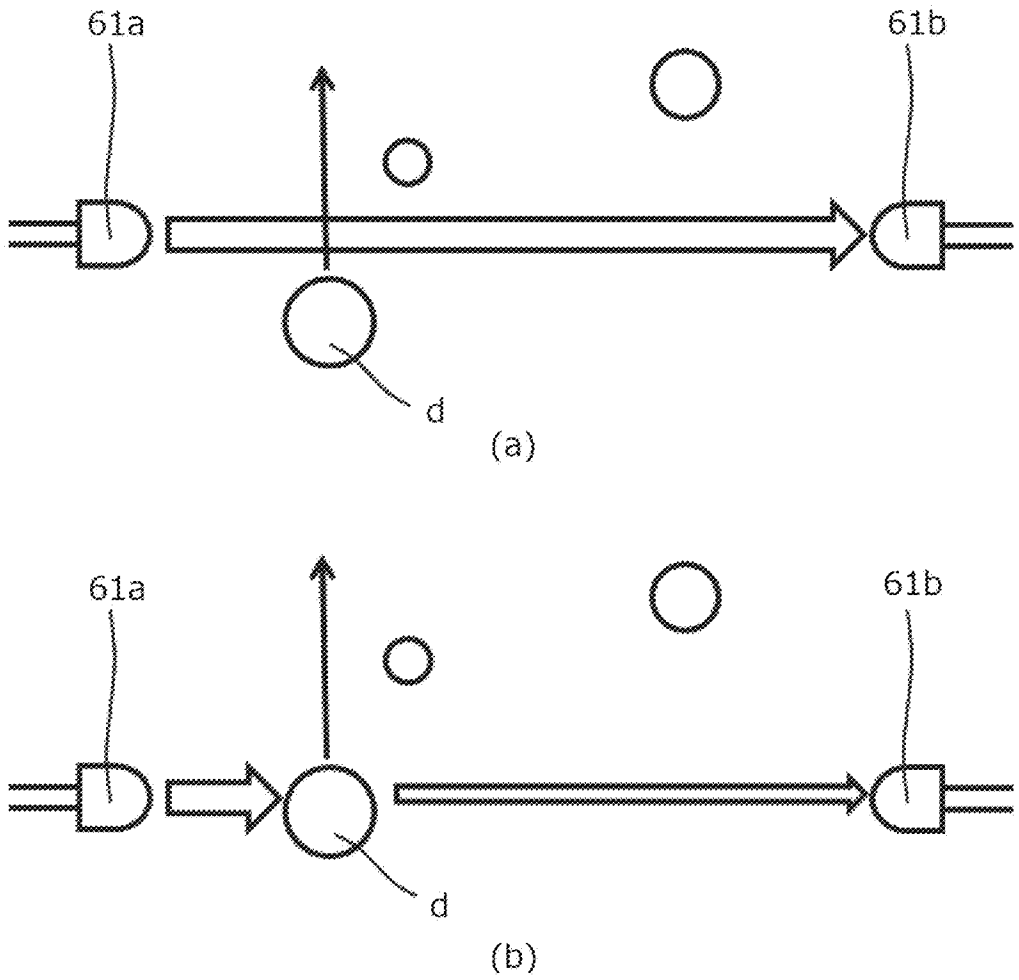
FIG. 8 is an explanatory view for describing a principle in which a dust detection section 61 according to the first embodiment of the present invention detects dust.

FIG. 8 is an explanatory view illustrating a principle of detecting dust by the dust detection section 61, wherein (a) illustrates the case in which light from the light-emitting unit 61*a* is not intercepted by dust, while (b) illustrates the case in which light from the light-emitting unit 61*a* is intercepted by dust. Notably, d indicates dust sucked by the self-propelled cleaner 1, and the dust d is supposed to be sucked upward in the figure.

In FIG. 8(*a*), light from the light-emitting unit 61*a* is not intercepted by the dust d, so that an output from the light-receiving unit 61*b* becomes almost constant. On the other hand, in FIG. 8(*b*), a part of light from the light-emitting unit 61*a* is intercepted by the dust d, which results in the decrease in the output from the light-receiving unit 61*b*. Specifically, the dust detection section 61 detects dust from the change in the output from the light-receiving unit 61*b*, the change being generated by dust passing between the light-emitting unit 61*a* and the light-receiving unit 61*b*.

Figure 9:
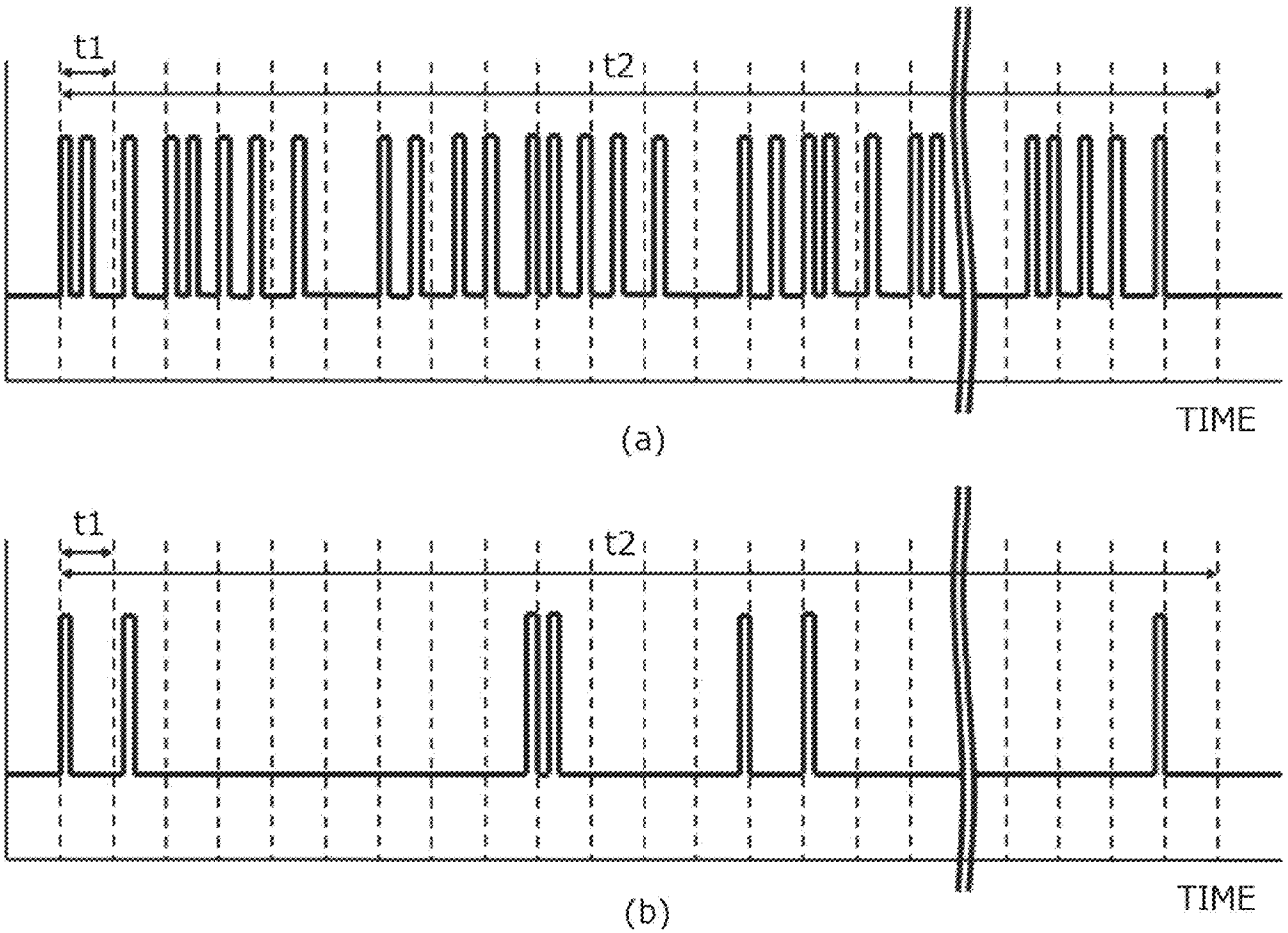
FIG. 9 is a schematic diagram illustrating one example of pulses outputted from a pulse generation circuit 61*d* according to the first embodiment of the present invention.

FIG. 9 is a schematic diagram illustrating one example of pulses outputted from the pulse generation circuit 61*d*. Every time dust is detected, a pulse is generated. FIG. 9(*a*) illustrates the case in which it is determined that an amount of dust on a floor surface is large, while FIG. 9(*b*) illustrates the case in which it is determined that an amount of dust on a floor surface is small.

Firstly, the dust amount determination section 100*a* counts a number of pulses during a period t2, which is specified such that a point at which a pulse is detected is defined as a starting point and a point after a lapse of the period t2 from the starting point is defined as an end point. In the present embodiment, when there are two or more pulses in a period t1 which is formed by equally dividing the period t2 in a predetermined number, the number of pulses in the period t1 is counted as one. The dust detection section 61 detects even small dust with excellent sensitivity, so that the number of detection times is likely to increase, although the amount of dust is very little. Counting the number of pulses with the above method can prevent an extreme increase in the number of pulses in the case where a lot of small dust is contained in the sucked dust, for example, whereby an amount of dust can properly be determined.

Then, the dust amount determination section 100*a* compares the counted number of pulses and the threshold value of the number of pulses stored beforehand in the storage section 101 to determine an amount of dust.

FIG. 10 is a table illustrating a relationship between a type of a floor surface and a threshold value of a number of pulses, which are stored in the storage section 101. In FIG. 10, S indicates a type of a floor surface, and N indicates a threshold value of a number of pulses corresponding to each floor surface. In the present embodiment, the threshold value N of the number of pulses is associated with the type of a floor surface determined by the floor surface determination section 100*b*.

For example, when the last determined floor surface is a wooden floor, the dust amount determination section 100*a* compares the counted number of pulses and the threshold value n1 of the number of pulses. Then, the dust amount determination section 100*a* determines that the amount of dust is small when the counted number of pulses is less than n1, while it determines that an amount of dust is large when the counted number of pulses is equal to or greater than n1. When the last determined floor surface is a tatami mat, the dust amount determination section 100*a* compares the counted number of pulses and the threshold value n2 of the number of pulses. Then, the dust amount determination section 100*a* determines that the amount of dust is small when the counted number of pulses is less than n2, while it determines that an amount of dust is large when the counted number of pulses is equal to or greater than n2. When the last determined floor surface is a carpet, the dust amount determination section 100*a* compares the counted number of pulses and the threshold value n3 of the number of pulses. Then, the dust amount determination section 100*a* determines that the amount of dust is small when the counted number of pulses is less than n3, while it determines that an amount of dust is large when the counted number of pulses is equal to or greater than n3.

Here, n1 is a value larger than n2 and n3. n2 is a value larger than n3. Specifically, in the case of a wooden floor, most of dust on this floor surface is sucked and cleaned by the self-propelled cleaner 1 in relatively a short time. Therefore, the number of detection times is likely to increase compared to the other floor surfaces, although an amount of dust on the floor surface is equal. Accordingly, n1 is set to be larger than n2 and n3. On the other hand, in the case of a carpet, most of dust is present between naps of the carpet, so that relatively long time is needed to suck such dust by the self-propelled cleaner 1. Therefore, the number of detection times is likely to decrease compared to the other floor surfaces, although an amount of dust on the floor surface is equal. Accordingly, n3 is set to be smaller than n1 and n2. In the case of a tatami mat, some dust is present in the tatami mesh, and there is a tendency intermediate between the wooden floor case and the carpet case. Accordingly, n2 is set to be smaller than n1 and larger than n3.

Next, an operation of the self-propelled cleaner 1 will be described.

(Operation of Self-Propelled Cleaner 1)

The operation described below is executed when the control section 100 of the self-propelled cleaner 1 executes the program stored in the storage section 101.

Figure 11:
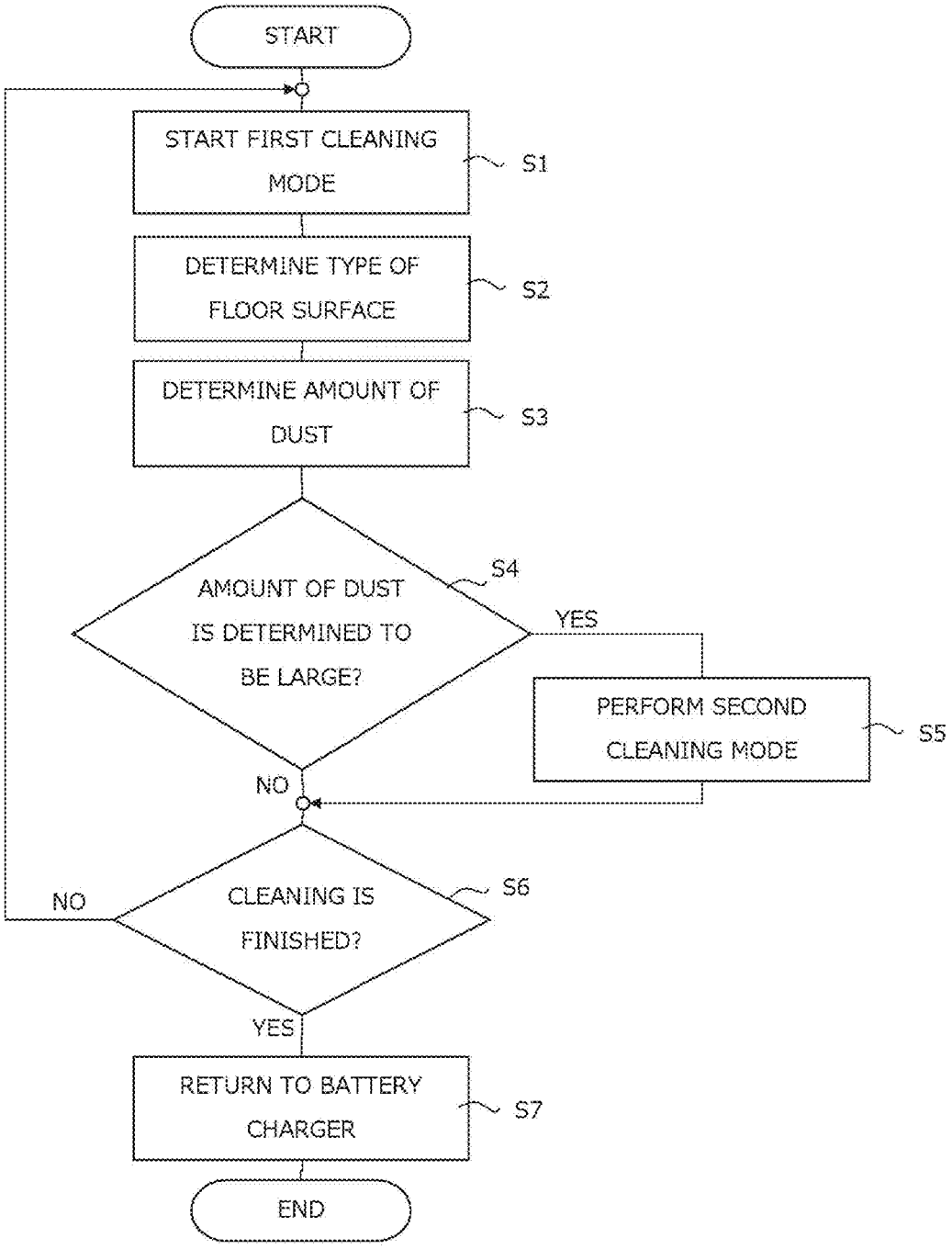
FIG. 11 is a flowchart illustrating a cleaning operation executed by the self-propelled cleaner 1 according to the first embodiment of the present invention.

FIG. 11 is a flowchart of a cleaning operation executed by the self-propelled cleaner 1. In the flowcharts illustrated in FIG. 11 and following drawings, "step" is indicated by "S". "S" also indicates "step" in the description.

When receiving an instruction to start cleaning, the self-propelled cleaner 1 starts the cleaning operation. The instruction to start cleaning is issued by a user's operation on an operation panel (not illustrated) provided to the self-propelled cleaner 1 or an operation on a remote controller (not illustrated). The instruction to start cleaning may be issued when the time set beforehand with a timer operation has come.

After the cleaning operation is started, the control section 100 controls each section of the self-propelled cleaner 1 so as to start a first cleaning mode (S1). Specifically, the control section 100 drives the electric blower 4 to generate a negative pressure in the self-propelled cleaner 1 to generate an air current for sucking dust on a floor surface, and controls the wheel drive section 50 to move the self-propelled cleaner 1 with a predetermined movement pattern by the drive wheels 5. The control section 100 also controls the brush drive section 90 to rotate the main brush 9 and the side brushes 8.

Next, the floor surface determination section 100*b* of the control section 100 determines a type of the floor surface (S2). Specifically, the control section 100 allows the current detection section 92 to detect a motor current value of the brush drive section 90, and allows the floor surface determination section 100*b* to determine the type of the floor surface based on the motor current value of the brush drive section 90 detected by the current detection section 92 and the table indicating the relationship between a type of a floor surface and a motor current value stored in the storage section 101.

Then, the dust amount determination section 100*a* of the control section 100 determines an amount of dust on the floor surface (S3). Specifically, the control section 100 allows the dust detection section 61 to detect dust, and compares the number of pulses outputted from the dust detection section 61 and the threshold value of the number of pulses stored beforehand in the storage section 101 to determine the amount of dust. In this case, the threshold value of the number of pulses according to the type of the floor surface determined in S2 is used.

When the amount of dust is determined to be large ("YES" in S4), the control section 100 controls each section of the self-propelled cleaner 1 so as to execute a second cleaning mode (S5). The second cleaning mode is a mode for carefully cleaning the place where an amount of dust is determined to be large.

When the amount of dust is determined to be small ("NO" in S4), and when the second cleaning mode is ended, the control section 100 determines whether it ends the cleaning operation or not (S6). The control section 100 determines to end the cleaning operation, when a predetermined time has elapsed from the start of the cleaning operation, for example. The control section 100 may also determine to end the cleaning operation, when a remaining battery charge becomes equal to or smaller than a predetermined value. The control section 100 may also determine to end the cleaning operation, when receiving an instruction to end the cleaning operation from the user.

When determining to end the cleaning operation ("YES" in S6), the control section 100 controls each section of the self-propelled cleaner 1 to end the cleaning operation and allow the self-propelled cleaner 1 to return to the battery charger (S7). When determining not to end the cleaning operation ("NO" in S6), the control section 100 returns to S1 to continue the first cleaning operation.

Next, a specific example of the second cleaning mode will be described.

i) Repeatedly Clean Region Determined to have a Lot of Dust

Figure 12:
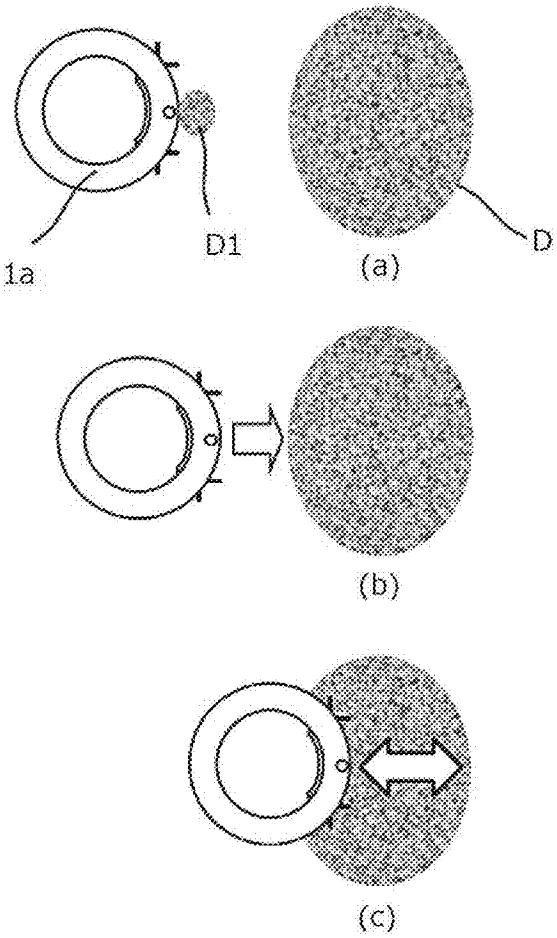
FIG. 12 is an explanatory view illustrating one example of a second cleaning mode according to the first embodiment of the present invention.

FIG. 12 is an explanatory view illustrating one example of the second cleaning mode, wherein (a) illustrates the state after the self-propelled cleaner 1 performs the first cleaning, (b) illustrates the state after the self-propelled cleaner 1 performs the second cleaning, and (c) illustrates the state after the self-propelled cleaner 1 performs the third cleaning. D indicates a region having a lot of dust. FIG. 12 schematically illustrates that dust is removed with the third cleaning. However, dust on the floor surface is actually decreased every cleanings.

When it is determined that an amount of dust is large, the control section 100 performs the first cleaning up to the place where the amount of dust is next determined to be small (the state in FIG. 12(*a*)), and controls the self-propelled cleaner 1 to turn around at this place to clean again the same region. Then, the control section 100 performs the second cleaning for the region having a lot of dust (the state in FIG. 12(*b*)), and then, allows the self-propelled cleaner 1 to turn around at this place to clean again the same region. After performing the cleaning three times for the same region (the state in FIG. 12(*c*)), the control section 100 controls the self-propelled cleaner 1 to continue the cleaning operation with the first cleaning mode.

In the above embodiment, the self-propelled cleaner 1 repeatedly performs cleaning for the region from the point first determined to have a lot of dust to the point next determined to have a little dust. However, it is not limited thereto. For example, the self-propelled cleaner 1 may repeatedly perform cleaning for a region with a predetermined distance from the point first determined to have a lot of dust.

In the above embodiment, the self-propelled cleaner 1 repeats cleaning three times. However, the number of repetitions can appropriately be selected. When the number of repetitions of cleaning is set as an odd number such as three times or five times, the cleaning can be continued from the point where the second cleaning mode is started.

ii) Perform Cleaning Around Point Determined to have a Lot of Dust

Figure 13:
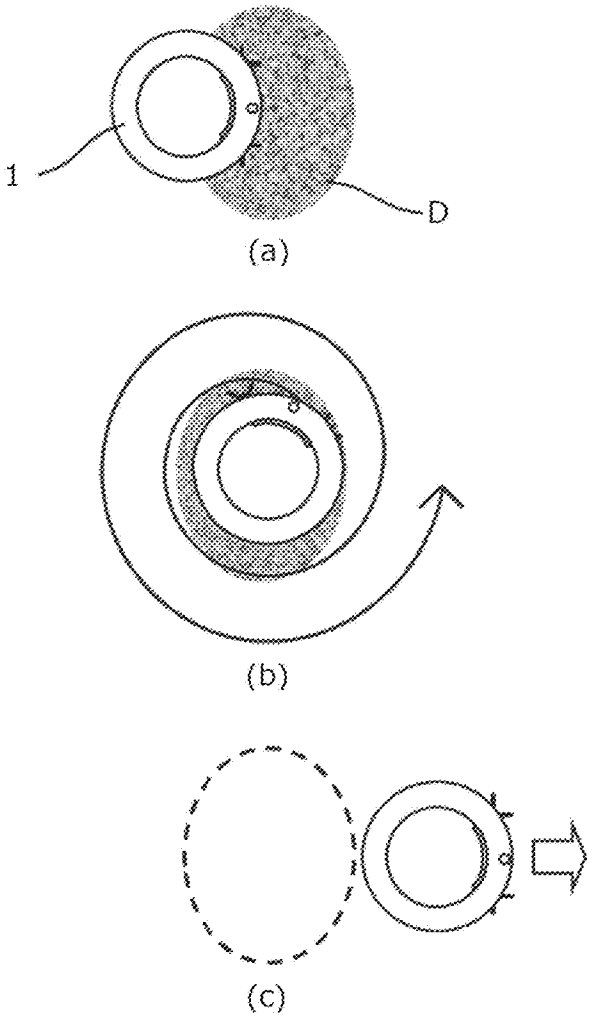
FIG. 13 is an explanatory view illustrating another example of a second cleaning mode according to the first embodiment of the present invention.

FIG. 13 is an explanatory view illustrating another example of the second cleaning mode, wherein (a) illustrates the state in which the self-propelled cleaner 1 determines that an amount of dust is large, (b) illustrates the state in which the self-propelled cleaner 1 currently performs the second cleaning mode, and (c) illustrates the state after the self-propelled cleaner 1 ends the second cleaning mode.

When an amount of dust is determined to be large (the state in FIG. 13(*a*)), the control section 100 controls the self-propelled cleaner 1 to move with a predetermined movement pattern and perform a cleaning operation around a point determined to have a lot of dust (the state in FIG. 13(*b*)). After finishing the cleaning with the predetermined movement pattern (the state in FIG. 13(*c*)), the control section 100 controls the self-propelled cleaner 1 to continue the cleaning operation with the first cleaning mode.

In the above embodiment, the predetermined movement pattern is spiral in a plan view. However, it is not limited thereto. The movement pattern may be zigzag, for example.

iii) Perform Cleaning by Changing Rotation Speed of Electric Blower 4

When an amount of dust is determined to be large, the control section 100 controls the self-propelled cleaner 1 to perform cleaning with an increase in the rotation speed of the electric blower 4. The control section 100 can generate stronger negative pressure in the self-propelled cleaner 1 by increasing the rotation speed of the electric blower 4, whereby the self-propelled cleaner 1 can suck dust with stronger suction power.

Notably, the rotation speed of the main brush 8, the side brushes 8, and/or the drive wheels 5 may be changed, in place of the change in the rotation speed of the electric blower 4 or in addition to the change in the rotation speed of the electric blower 4. When the rotation speed of the main brush 9 or the side brushes 8 is increased, more dust can be scraped or swept by the rotation of the brush, whereby cleaning capability is enhanced. When the rotation speed of the drive wheels 5 is decreased, the region having a lot of dust can be cleaned over time, whereby cleaning capability is enhanced.

iv) Combine Cleaning Modes i to iii

When an amount of dust is determined to be large, the control section 100 can appropriately combine the above cleaning modes i to iii for cleaning.

As described above, at least the period t2 is required till the mode is changed to the second cleaning mode after the dust detection section 61 detects dust. To solve this time lag, the control section 100 may allow the self-propelled cleaner 1 to move backward with a predetermined distance before or after the changeover to the second cleaning mode, and then, allow the self-propelled cleaner 1 to move forward again to execute the second cleaning mode.

Second Embodiment

A self-propelled cleaner 1*a* according to a second embodiment of the present invention will be described with reference to the drawings. The self-propelled cleaner 1*a* according to the present embodiment is different from the above embodiment in that it performs determination as to an amount of dust except for an amount of dust during a predetermined period. The components described in the first embodiment have the function similar to the first embodiment, and their description is omitted, unless otherwise specified.

Figure 14:
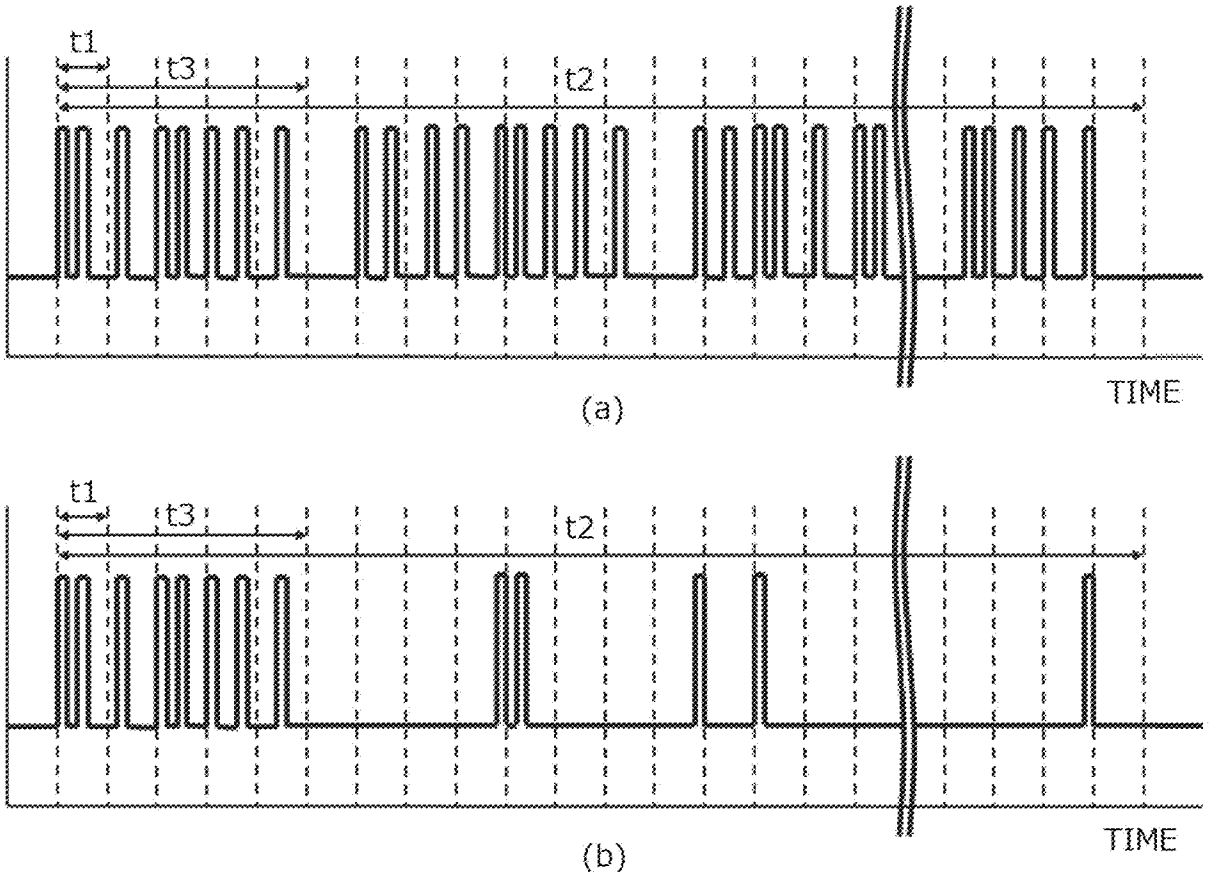
FIG. 14 is a schematic diagram illustrating one example of pulses outputted from a pulse generation circuit 61*d* according to a second embodiment of the present invention.

FIG. 14 is a schematic diagram illustrating one example of pulses outputted from a pulse generation circuit 61*d*. A pulse indicates that dust is detected. FIG. 14(*a*) illustrates the case in which an amount of sucked dust is determined to be large, and FIG. 14(*b*) illustrates the case in which a mass of dust is sucked in a certain period.

Similar to the first embodiment, the dust amount determination section 100*a* is supposed to count a number of pulses during a period t2, which is specified such that a point at which a pulse is detected is defined as a starting point and a point after a lapse of the period t2 from the starting point is defined as an end point in the present embodiment. In addition, when there are two or more pulses in a period t1 which is formed by equally dividing the period t2 in a predetermined number, the dust amount determination section 100*a* is supposed to count the number of pulses in the period t1 as one in the present embodiment.

When pulses are concentrated during a certain period t3 included in the period t2, the dust amount determination section 100*a* according to the present embodiment counts the number of pulses except for the pulses during the period t3. For example, when the number of pulses during the period t3 becomes larger than a predetermined value, the dust amount detection section 100*a* may exclude the number of pulses included in the period t3.

FIG. 14(*b*) illustrates that the period t3 appears at the beginning of the period t2. However, even when the period t3 appears at other points in the period t2, the number of pulses during the period t3 can similarly be excluded.

Even in FIG. 14(*a*), the period where a lot of pulses are first detected in the period t2 is specified as the period t3, and the dust amount determination section 100*a* may count the number of pulses except for the pulses during this period t3. The plurality of pulses concentrated during the period t3 in FIG. 14(*b*) corresponds to a sucked small mass of dust. Specifically, when a mass of dust is sucked, many pulses are detected in a short period. In the present embodiment, the pulses during the period t3 are excluded in order to exclude the pulses corresponding to a mass of dust. The dust amount determination section 100*a* then compares the counted number of pulses and the threshold value of the number of pulses stored beforehand in the storage section 101 to determine an amount of dust. Specifically, in FIG. 14(*b*), the pulses during the period t3 are excluded, so that the counted number of pulses is decreased. Accordingly, it is determined that an amount of dust is small.

Figure 15:
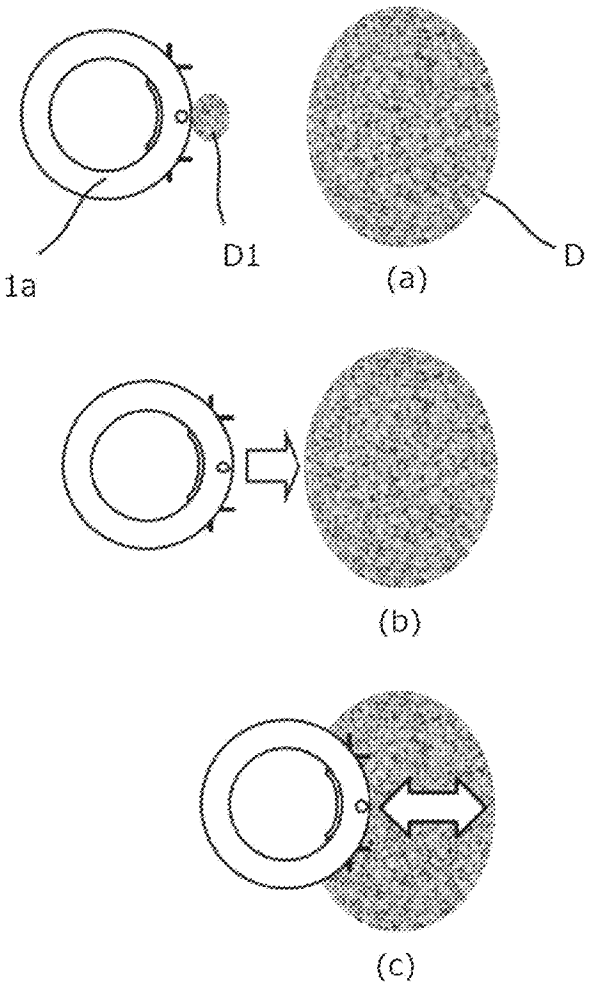
FIG. 15 is a schematic view illustrating one example of a cleaning operation executed by a self-propelled cleaner 1*a* according to the second embodiment of the present invention.

FIG. 15 is a schematic view illustrating one example of a cleaning operation executed by the self-propelled cleaner 1*a*, wherein (a) illustrates the state in which the self-propelled cleaner 1*a* approaches a mass of dust, (b) illustrates the state in which the self-propelled cleaner 1*a* passes through the mass of dust, and (c) illustrates the state in which the self-propelled cleaner 1*a* approaches a region having a lot of dust and executes a second cleaning mode. In FIG. 15, D1 indicates a mass of dust, and D indicates a region having a lot of dust.

When the self-propelled cleaner 1*a* approaches the mass of dust (the state in FIG. 15(*a*)), the dust detection section 61 detects dust, and generates an output in which pulses are concentrated during a part of the period t2 as an output corresponding to the detected dust. The dust amount determination section 100*a* counts the number of pulses during the period t2 except for the pulses concentrated during the part of the period t2. As a result, the dust amount determination section 100*a* determines that an amount of dust on this point is small, so that the self-propelled cleaner 1*a* passes through the mass of dust D1 and continues the cleaning operation with the first cleaning mode without executing the second cleaning mode (the state in FIG. 15(*b*)). On the other hand, when the self-propelled cleaner 1*a* approaches the region D having a lot of dust, the dust amount determination section 100*a* determines that an amount of dust is large. Therefore, the self-propelled cleaner 1*a* cleans the region D having a lot of dust with the second cleaning mode. In the embodiment in FIG. 15, the self-propelled cleaner 1*a* repeatedly cleans the region, which is determined to have a lot of dust, with the second cleaning mode.

Third Embodiment

A self-propelled cleaner 1*b* according to a third embodiment of the present invention will be described with reference to the drawings. The self-propelled cleaner 1*b* according to the present embodiment is different from the above embodiment in that an operating test for the dust detection unit is performed at a predetermined timing. The components described in the first embodiment have the function similar to the first embodiment, and their description is omitted, unless otherwise specified.

Figure 16:
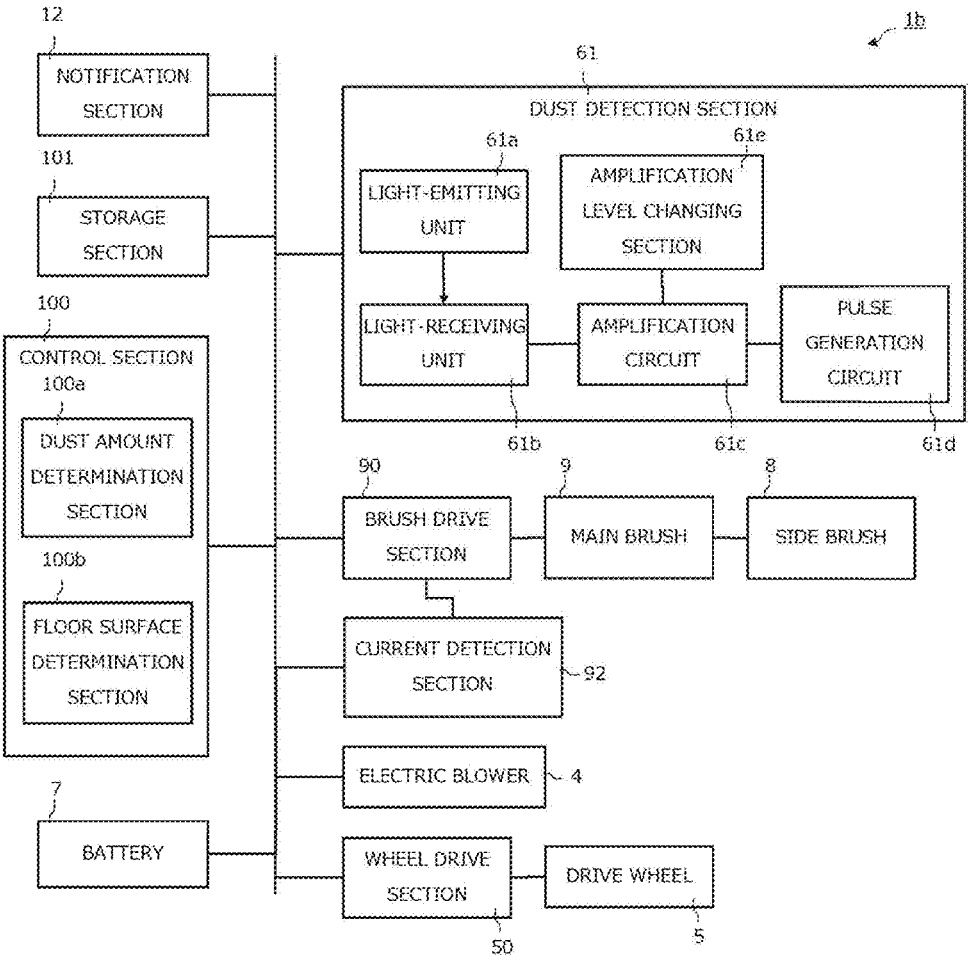
FIG. 16 is a block diagram illustrating a main configuration of a self-propelled cleaner 1*b* according to a third embodiment of the present invention.

FIG. 16 is a block diagram illustrating a main configuration of the self-propelled cleaner 1*b*.

A dust detection section 61 includes an amplification level changing section 61*e*. The amplification level changing section 61*e* changes an amplification level upon amplifying an output from a light-receiving unit 61*b* by an amplification circuit 61*c*. For example, when a current-voltage conversion circuit is used as the amplification circuit 61*c*, the amplification level changing section 61*e* can change an amplification level by changing a resistance value of a resistor included in the current-voltage conversion circuit.

The self-propelled cleaner 1*b* also includes a notification section 12. The notification section 12 notifies a user of an abnormality caused in the self-propelled cleaner 1*b*. The notification section 12 may include a speaker to issue notification to the user with a sound, or may include an LED or a liquid crystal display device to issue notification to the user with lighting or flashing of the LED or a display of the liquid crystal display device. When the self-propelled cleaner 1*b* is connected to a communication network such as Internet or LAN (Local Area Network) at home, the notification section 12 may notify a user by transmitting information relating to an abnormality of the self-propelled cleaner 1*b* to an external server device, or a cellular phone, a smartphone, or a PC (Personal Computer) of the user via the communication network.

Figure 17:
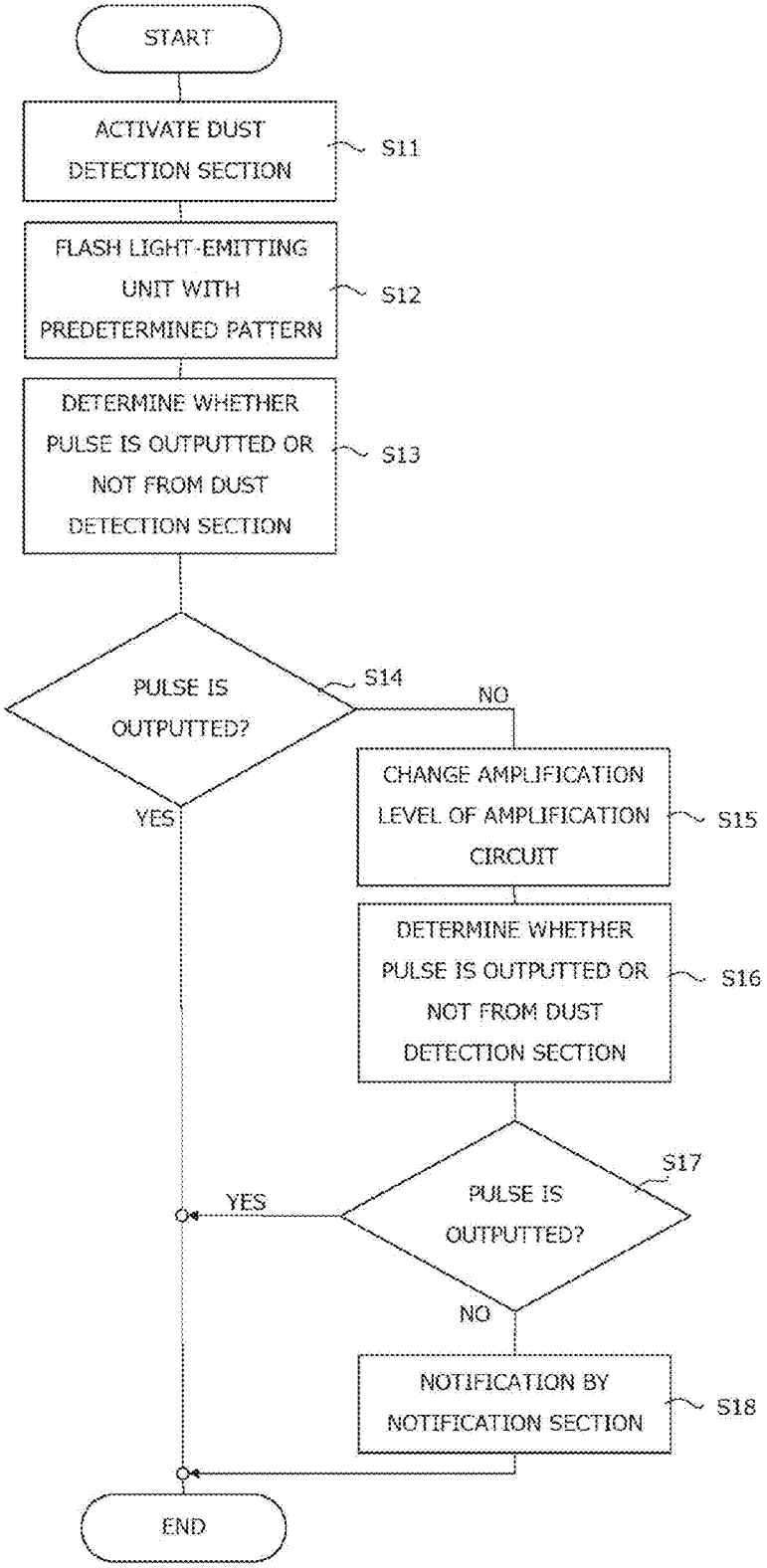
FIG. 17 is a flowchart illustrating an operating test executed by the self-propelled cleaner 1*b* according to the third embodiment of the present invention.
Figure 19:
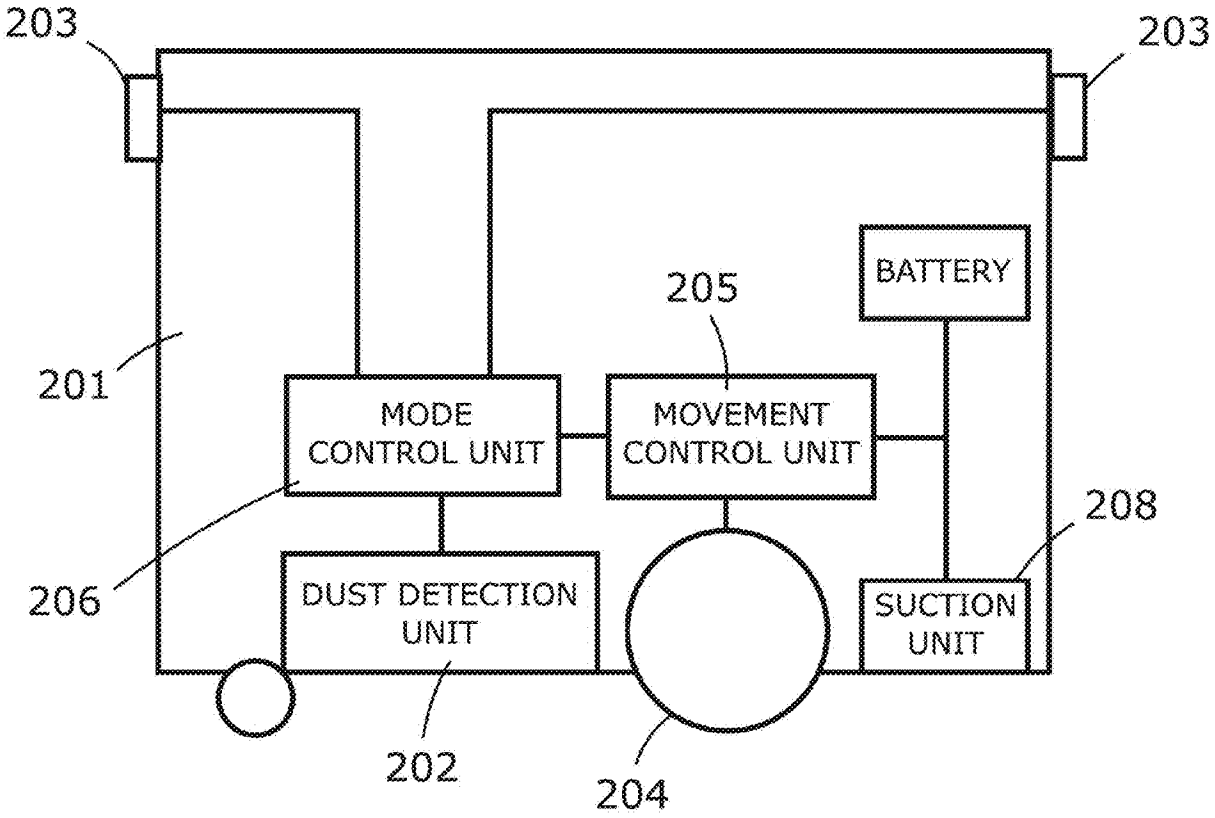
FIG. 19 is a block diagram illustrating a self-propelled device 201 described in Patent Document 1.

FIG. 17 is a flowchart of an operating test for the dust detection section 61 executed by the self-propelled cleaner 1*b*. The operating test for the dust detection section 61 is executed before the start of the cleaning operation, for example.

Firstly, the control section 100 operates the dust detection section 61, when receiving an instruction to start cleaning (S11). The instruction to start cleaning may be received in the same manner as in the first embodiment.

Then, the control section 100 controls to flash the light-emitting unit 61*a* of the dust detection section 61 with a predetermined pattern (S12). The control section 100 then determines whether a pulse is outputted or not from the dust detection section 61.

When a pulse is outputted in S13 ("YES" in S14), the control section 100 ends the operating test for the dust detection section 61. Thereafter, the self-propelled cleaner 1*b* performs a predetermined cleaning operation.

On the other hand, when a pulse is not outputted in S13 ("NO" in S14), the control section 100 controls to increase an amplification level of the amplification circuit 61*c* by the amplification level changing section 61*e*. Then, the control section 100 again determines whether a pulse is outputted or not from the dust detection section 61 (S16).

When a pulse is outputted in S16 ("YES" in S17), the control section 100 ends the operating test for the dust detection section 61. Then, the self-propelled cleaner 1*b* performs a predetermined cleaning operation.

When a pulse is not outputted in S17 ("NO" in S17), the control section 100 notifies a user of an abnormality of the dust detection section 61 by the notification section 12 (S18). The notification by the notification section 12 is issued such that a sound of "Dust sensor is dirty" is outputted from the speaker. The notification by the notification section 12 may be issued to encourage the user to clean the dust detection section 61, such as "Clean the dust sensor." Then, the control section 100 ends the operating test for the dust detection section 61. Thereafter, when detecting that the user cares for the dust detection section 61, the control section 100 may again perform the operating test for the dust detection section 61. The control section 100 may detect whether the dust detection section 61 is cared for or not by detecting the detachment or attachment of the main brush 9 from or to the housing 2, or by detecting an operation of an error release button mounted to the self-propelled cleaner 1. On the other hand, when a predetermined period has elapsed with no care to the dust detection section 61 by a user after the end of the operating test for the dust detection section 61, the self-propelled cleaner 1*b* performs a cleaning operation, while stopping the changeover function between the first and second cleaning modes based on the dust detection.

Fourth Embodiment

A fourth embodiment will next be described. In the above embodiments, an aspect of a floor surface is detected by the detection of a load of the drive section of the brush unit by the floor surface detection unit. However, it is not limited thereto. The present embodiment describes another example of the floor surface detection unit according to the present invention.

The floor surface detection unit may detect an aspect of a floor surface by detecting a load of a drive section of a movement unit. For example, the load of the movement unit in the case where a floor surface is a carpet is likely to be more than the load of the movement unit in the case of a wooden floor.

Alternatively, the floor surface detection unit may include an imaging unit imaging a floor surface, and may detect an aspect of a floor surface by analyzing an image of a floor surface imaged by the imaging unit.

Alternatively, the floor surface detection unit may detect an aspect of a floor surface based on a map of a region to be cleaned including information about a floor surface. The map of the region to be cleaned may be created by a user beforehand, and stored in the self-propelled cleaner, for example.

The self-propelled cleaner according to the present invention may be configured such that a user can select an aspect of a floor surface, in place of mounting the floor surface detection unit. For example, the user can select a type of a floor surface in a room to be cleaned, and then, allow the self-propelled cleaner to perform the cleaning operation.

Fifth Embodiment

A fifth embodiment will next be described.

The above embodiments describe the self-propelled cleaner that switches between the first cleaning mode and the second cleaning mode for cleaning more carefully than the first cleaning mode, according to the detection result of the dust detection unit. However, the present invention is not limited thereto. For example, a self-propelled cleaner may have three or more cleaning modes, and may switch these three or more cleaning modes in a stepwise manner according to the detection result of the dust detection unit. Another example is that the self-propelled cleaner may perform a different second cleaning mode according to the detection result of the floor surface detection unit.

FIG. 18 is a table illustrating one example of a type of the second cleaning mode performed by the self-propelled cleaner 1 according to the present embodiment. In FIG. 18, S indicates a type of a floor surface, and M indicates one example of a second cleaning mode corresponding to each floor surface.

When the floor surface is determined to be a wooden surface, the control section 100 drives the electric blower 4 with a high-power mode, and controls the brush drive section 90 to rotate the main brush 9 with the rotation speed ("low-power" in FIG. 18 and the following description) same as that in the first cleaning mode, as the second cleaning mode. The control section 100 also controls the wheel drive section 90 to repeatedly clean the region determined to have a lot of dust.

When the floor surface is determined to be a tatami mat, the control section 100 drives the electric blower 4 with a high-power mode, and controls the brush drive section 90 to drive the main brush 9 with a low-power mode, as the second cleaning mode. The control section 100 does not repeatedly clean the region determined to have a lot of dust.

When the floor surface is determined to be a carpet, the control section 100 drives the electric blower 4 with a high-power mode, and controls the brush drive section 90 to rotate the main brush 9 with the rotation speed ("high-power" in FIG. 18 and the following description) higher than that in the first cleaning mode, as the second cleaning mode. The control section 100 also controls the wheel drive section 90 to repeatedly clean the region determined to have a lot of dust.

With the execution of the second cleaning mode as described above, the main brush 9 is operated with the low-power mode, and the repeated cleaning is not performed, in the case of a tatami mat. This can prevent the surface of the tatami mat from being damaged by the main brush 9 or the drive wheels 5. In the case of a carpet, the main brush 9 is operated with the high-power mode, so that dust entering between naps of the carpet can be scraped out and swept. Specifically, the self-propelled cleaner 1 can more effectively perform cleaning by appropriately setting the detail of the second cleaning mode according to a type of a floor surface.

Other Embodiments

In the above embodiments, a control board 10 including all of or an essential part of the control section 100 and the storage section 101 may be formed into a unit for distribution, and this unit may be incorporated into a body to produce a finished product (sixth embodiment).

At least a part of the control section 100 of the self-propelled cleaner 1 may be constructed as a hardware with a logical circuit formed on an integrated circuit, or may be implemented by software by use of a CPU (Central Processing Unit) (seventh embodiment).

When the control section 100 is implemented by software, the self-propelled cleaner 1 includes a CPU executing a command of a control program for implementing each function, a ROM storing the above program, a RAM developing the above program, and a storage device (recording medium), such as a memory, for storing the program and various data pieces. The object of the present invention can also be attained by the configuration in which a recording medium on which a program code of the control program of the self-propelled cleaner 1 is recorded in a computer-readable manner is supplied to the self-propelled cleaner 1, and the computer reads and executes the program code recorded on the recording medium, wherein the control program is software for implementing the above function (eighth embodiment).

Any recording medium can be used. Examples of the usable recording mediums include tapes such as a magnetic tape or a cassette tape; disks including a magnetic disk such as a floppy (registered trademark) disk or a hard disk and an optical disk such as a CD-ROM, MO, MD, DVD, or CD-R; cards such as an IC card (including a memory card) or an optical card; semiconductor memories such as a mask ROM, EPROM (Erasable Programmable Read Only Memory), EEPROM (Electrically Erasable Programmable Read-Only Memory), or flash ROM; and logical circuits such as a PLD (Programmable logic device).

Alternatively, the self-propelled cleaner 1 is configured to be connectable to a communication network, and the above program code may be supplied via the communication network. The communication network is not particularly limited. Examples of the usable communication network include Internet, intranet, extranet, LAN, ISDN (Integrated Services Digital Network), VAN (value added network), CATV communication network, virtual private network, telephone network, mobile communication network, and satellite communication network. A transfer medium forming a communication network is not particularly limited, and usable examples of the transfer medium include a wired connection such as IEEE 1393, USB (Universal Serial Bus), power line carrier, cable TV network, telephone line, or ADSL (Asymmetric Digital Subscriber Line); and a wireless connection such as an infrared ray of IrDA or remote controller, Bluetooth (registered trademark), IEEE 802.11 radio wave, HDR (High Data Rate), NFC (Near Field Communication), DLNA (Digital Living Network Alliance), cellular phone network, satellite network, or digital terrestrial network.

SUMMARY

As mentioned above, the self-propelled cleaner includes: a movement unit configured to move a housing; a blower unit configured to generate an air current for sucking dust on a floor surface into the housing; a dust detection unit configured to detect dust contained in the air current; and a control unit configured to control the movement unit and/or the blower unit to select a cleaning mode according to a detection result of the dust detection unit, wherein the control unit is capable of changing a threshold value for selecting the cleaning mode.

The floor surface detection unit of the above mentioned self-propelled cleaner detects an aspect of a floor surface, e.g., a type of the floor surface. A wooden floor, a tatami mat and a carpet are examples of the type of the floor surface. However the aspect of the floor surface is not limited thereto.

With the configuration of the self-propelled cleaner as described above, the threshold value for selecting the cleaning mode can be changed according to an aspect of a floor surface, whereby a self-propelled cleaner that reduces dust which is left without being removed and has enhanced cleaning efficiency according to an aspect of a floor surface can be implemented.

The self-propelled cleaner may further includes: a floor surface detection unit configured to detect an aspect of a floor surface, wherein the control unit may change the threshold value according to the detection result of the floor surface detection unit.

With the configuration of the self-propelled cleaner as described above, the self-propelled cleaner can autonomously change the threshold value for selecting the cleaning mode, whereby a convenience of a user can be enhanced. In addition, the user can efficiently perform cleaning by appropriately selecting the cleaning mode, even if the state of the floor surface is different from place to place in the same room.

The control unit may select the cleaning mode according to a number of detection times of dust during a first period set beforehand.

With the configuration of the self-propelled cleaner as described above, the number of detection times of dust can be averaged, whereby an erroneous detection by the dust detection unit can be reduced.

The control unit may count the number of detection times of dust by excluding a second period set beforehand during the first period.

With the configuration of the self-propelled cleaner as described above, the situation in which the cleaning mode is changed every time a small mass of dust is detected can be reduced, whereby cleaning efficiency can further be enhanced.

The self-propelled cleaner may further include: a drive unit; and a brush unit configured to be driven by the drive unit to clean a floor surface, wherein the floor surface detection unit may detect the aspect of a floor surface by detecting a load to the drive unit caused by the drive of the brush unit.

With the configuration of the self-propelled cleaner as described above, the brush unit for the cleaning can also be utilized for the detection of the floor surface.

The embodiments of the present invention described herein should be considered in all respects as illustrative and not restrictive of the present invention. The scope of the present invention is not limited to the above description, but the accompanying claims and their equivalents are intended to cover such forms or modifications as would fall within the scope and spirit of the invention.

INDUSTRIAL APPLICABILITY

The self-propelled cleaner according to the present invention is widely applicable to a self-propelled cleaner provided with a movement unit.

EXPLANATION OF NUMERALS

1, 1*a*, 1*b* Self-propelled cleaner
2 Housing
2*a* Lid
2*b* Exhaust port
3 Signal receiving section
4 Electric blower (blowing unit)
5 Drive wheel (movement unit)
50 Wheel drive section (movement unit)
6 Dust collection section
7 Battery
8 Side brush (brush unit)
9 Main brush (brush unit)
90 Brush drive section
92 Current detection section (floor surface detection unit)
10 Control board
11 Charging terminal
61 Dust detection section (dust detection unit)
61*a* Light-emitting unit
61*b* Light-receiving unit
61*c* Amplification circuit
61*d* Pulse generation circuit
61*d* Amplification level changing section
100 Control section (control unit)
100*a* Dust amount determination section
100*b* Floor surface determination section

The invention claimed is:

1. A self-propelled cleaner for executing a cleaning operation comprising:

a movement unit configured to move a housing;

a blower unit configured to generate an air current for sucking dust on a floor surface into the housing;

a dust detection unit configured to detect dust contained in the air current;

a floor surface detection unit configured to detect an aspect of a floor surface; and a control unit configured to control the movement unit and/or the blower unit to select a cleaning mode between a first cleaning mode and a second cleaning mode, the second cleaning mode being for cleaning more carefully than the first cleaning mode, according to a detection result of the dust detection unit, wherein the control unit is capable of changing a threshold value for selecting the cleaning mode according to the detected aspect of the floor surface, and wherein a type of the cleaning operation in the second cleaning mode varies according to the detected aspect of the floor surface.

2. The self-propelled cleaner according to claim 1, further comprising:

a drive unit; and a brush unit configured to be driven by the drive unit to clean a floor surface, wherein the control unit controls a rotation of the brush unit in the second cleaning mode according to the detected aspect of the floor surface.

3. The self-propelled cleaner according to claim 2, wherein the floor surface detection unit detects the aspect of the floor surface by detecting a load to the drive unit caused by the drive of the brush unit.

4. The self-propelled cleaner according to claim 1, wherein the control unit selects the cleaning mode according to a number of detection times of dust during a first period set beforehand.

5. The self-propelled cleaner according to claim 4, wherein the control unit counts the number of detection times of dust by excluding a second period set beforehand during the first period.

* * * * *